United States Patent [19]

Stern

[11] 4,430,170

[45] Feb. 7, 1984

[54] ELECTRODEPOSITION OF REFRACTORY METAL CARBIDES

[75] Inventor: Kurt H. Stern, Takoma Park, Md.

[73] Assignee: The United States of America as represented by the Secretary of the Navy, Washington, D.C.

[21] Appl. No.: 458,597

[22] Filed: Jan. 17, 1983

[51] Int. Cl.[3] ..... C25D 3/66; C25D 9/08; C25D 9/10

[52] U.S. Cl. ..... 204/39

[58] Field of Search ..... 204/39, 61

[56] References Cited

U.S. PATENT DOCUMENTS

| | | | |
|---|---|---|---|
| 2,950,233 | 8/1960 | Steinberg et al. | 204/39 X |
| 3,589,987 | 6/1971 | Gomes et al. | 204/61 |
| 3,887,443 | 6/1975 | Komatsu et al. | 204/39 |
| 3,912,827 | 10/1975 | Komatsu et al. | 204/39 X |
| 3,979,267 | 9/1976 | Townsend | 204/130 |
| 4,009,086 | 2/1977 | Komatsu et al. | 204/39 |

*Primary Examiner*—G. L. Kaplan

*Attorney, Agent, or Firm*—Robert F. Beers; William T. Ellis; Barry A. Edelberg

[57] ABSTRACT

A refractory metal carbide coating is electrodeposited onto an object, using a bath containing an alkali fluoride melt, an alkali carbonate dissolved in the melt, a refractory metal-containing compound also dissolved in the melt, and an anode composed of that refractory metal. The object to be coated is immersed into the bath as the anode, and a voltage is applied until the coating obtains the desired thickness. By this process, coatings such as tungsten carbide and tantalum carbide having a desired stoichiometric composition may be deposited on the surface of an object.

20 Claims, 1 Drawing Figure

ELECTRODEPOSITION OF REFRACTORY METAL CARBIDES

BACKGROUND OF THE INVENTION

This invention relates to electrodeposition and more particularly to the electrodeposition of refractory metal carbides.

For some time, man has recognized the advantages which greater hardness in metals offers. Harder metals, more resistant to wear, reduce the need for frequent, costly replacement of parts.

Abrasive wear afflicts all manner of machinery in which metal surfaces contact other surfaces. For example, erosive wear plagues metals exposed to high velocity gas streams carrying hard particles, as in coal gasification, or even the lower velocity, liquid-entrained coal particles in a slurry flowing through a pipeline. The wearing of metals is frequently aggravated by high temperatures which lead to simultaneous metal oxidation, particularly in the newer energy industries.

Several approaches to reducing wear have been taken. Chief among these has been the formulation of ever harder alloys, such as the newer ones based on cobalt. Another route has been to modify only surface properties, rather than the bulk of the metal. This has been done by covering the bulk metal with a coating of another alloy. Still another method has been to modify the surface layer of the metal either by diffusing other metals into the surface (metalliding), by ion implantation, or by laser melting.

It has long been recognized that refractory carbides possess precisely the desirable hardness missing from metals and are stable at fairly high temperatures. Nevertheless, such refractory carbides lack the desirable ductility of metals. Consequently there have been many attempts to combine the two in order to gain hardness combined with ductility. One well-known technique has been hard-facing, the incorporation of carbide particles into a bulk metal. Another has been to produce carbide coatings on metals. However, existing coating methods have not been entirely successful. Plasma spraying, which involves impinging the carbide powder on the surface to be coated, requires temperatures near 1500° C., is line-of-sight, and tends to produce somewhat porous coatings. Chemical vapor deposition can be carried out by combining two reactive gases so that the carbide reaction product is produced as a coating. Much development work has been done on this process, but the coatings are usually quite thin. Further, neither plasma spraying nor chemical vapor deposition allows any control over the stoichiometry of the coating.

In previous studies of electrochemical reduction, carbides were deposited from melts containing alkali metal fluorides and $B_2O_3$; the metal and carbon are introduced as the oxide and as carbonate, respectively. This method of electrolysis results in the formation of millimeter-size crystals on the walls of the graphite crucible which serves as the cathode. Analysis of these crystals shows that their composition varies with the metal oxide/carbonate ratio in the melt. However, no adherent coating of carbide is formed.

During the 1960's, Senderoff and Mellors showed that excellent coatings of the refractory metals could be electroplated from the ternary eutectic of (Li, Na, K)F by adding the metal as a complex fluoride, and plating between the appropriate metal anode and the cathode to be plated at 750°-800° C. "Coherent Coatings of Refractory Metals," Science, (1966) 153, 1475, is incorporated herein by reference. Dense, adherent, and ductile plates were obtained, and there seemed to be no upper limit to the plating thickness; in fact the substrate could be dissolved away to produce freestanding refactory metal objects. However, the inventors pointed out that not only halides other than fluoride, but also oxyanions, must be absent for the process to be satisfactory.

Since electrochemical reduction by previously developed methods did not prove to be an effective method of coating objects, and since Senderoff et al. did not discuss the electrodeposition of carbides, no basis existed for combining the teachings of these papers. Indeed, if one wished to adapt the Senderoff procedure to plating carbides, the prior art would be discouraging, since one would expect carbonates to interfere with metal deposition. In fact, initial attempts to introduce carbon by the anodic oxidation of graphite proved unsuccessful. When the melts were undried, gaseous fluoromethane was formed. In dried melts, carbon was inert. While these difficulties would not exist if carbon were introduced into the melt in the form of an alkali metal carbonate, it was believed, based on the work of Senderoff et al., that doing so would prevent successful plating by introducing oxyanions into the melt. Moreover, carbon is not the only possible product of carbonate reduction. For pure alkali metal carbonates, four reactions are possible:

$$CO_3^{2-}+4e=C+3O^{2-} \quad (1)$$

$$CO_3^{2-}+2e=CO+2O^{2-} \quad (2)$$

$$M^{+}+e=M^{\circ} \quad (3)$$

$$2CO_3^{2-}+10e=C_2^{2-}+6O_2^{2-} \quad (4)$$

For carbide formation to occur, reaction (1) is required. It was not known whether that reaction would be favored in a ternary fluoride melt.

OBJECTS OF THE INVENTION

An object of this invention is to protect metal surfaces of any shape from abrasive and erosive wear.

Another object of this invention is to provide a process for producing a hard, dense, adherent coating of a refractory metal carbide.

A further object of this invention is to provide a process for producing a coating of a refractory metal carbide of virtually any desired thickness.

A further object of this invention is to provide a process for electrodeposition of a refractory metal carbide whereby the stoichiometry of the metal carbide coating produced can be controlled.

SUMMARY OF THE INVENTION

These and other objects are achieved by electrodepositing a coating of a refractory metal carbide from a solution of a desired refractory metal fluoride in a molten alkali fluoride-alkali carbonate mixture. When a voltage is applied between an anode composed of the desired refractory metal and a cathode composed of the object to be coated, the carbonate and the metal cations in the solution are simultaneously reduced at the anode to form a metal carbide coating upon the object.

DESCRIPTION OF PREFERRED EMBODIMENT

Figure 1:
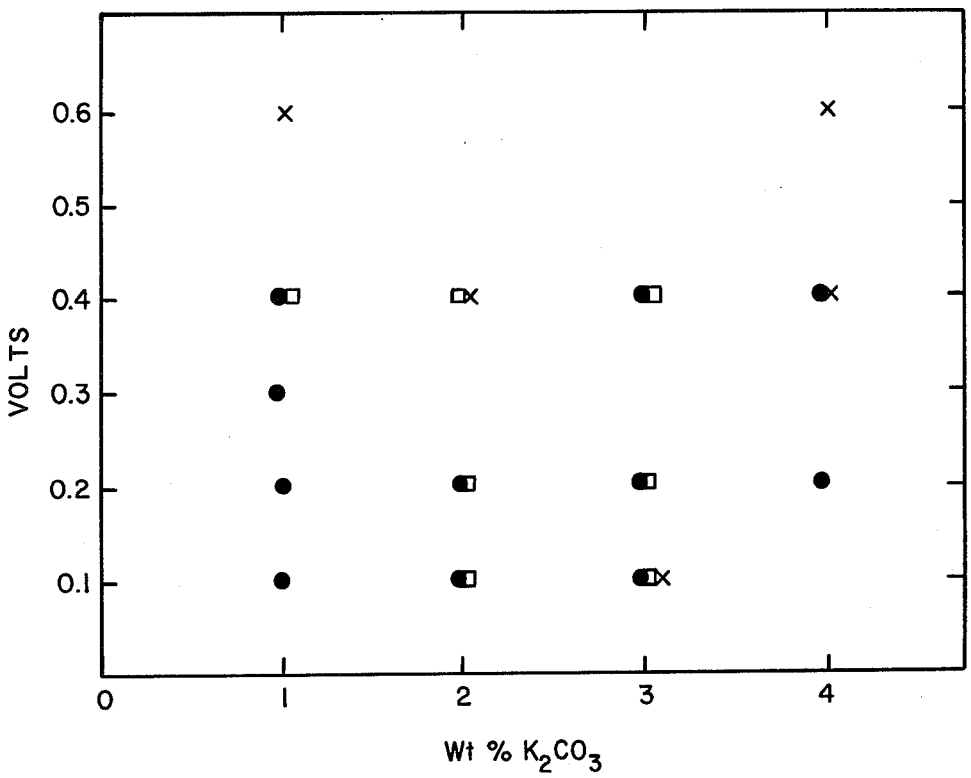
FIG. 1 graphically illustrates the influence of voltage and the weight percentage of $K_2CO_3$ in the melt based on the weight of the melt, on the stoichiometric composition of a coating of tantalum carbide deposited by the process of this invention. Ta is represented by the symbol "•"; $Ta_2C$ is represented by the symbol "□"; and TaC is represented by the symbol "X".

To carry out the process of this invention, an essentially pure alkali fluoride melt is first prepared and held under a flowing inert atmosphere in a sealed cell. Carbon is added to the melt in the form of an alkali carbonate, and the refractory metal to be electrodeposited is added to the melt in the form of a soluble metal-containing compound. In this description and the claims that follow, a metal-containing compound is soluble if, when added to the melt, the refractory metal ion enters into a stable complex ion within the melt. The object to be coated is placed into the melt as a cathode, and the elemental form of the refractory metal is placed into the melt as the anode. Electrolysis is then carried out in the traditional manner until the object has the desired thickness of coating on its surface. Virtually any thickness of coating may be deposited by the process of this invention.

Preferably, the alkali fluoride melt is composed of a eutectic mixture of more than one alkali fluoride, at least one of which wherein the alkali metal is potassium. Examples of such melts include, but are not limited to, the eutectic mixtures KF:LiF, NaF:KF, NaF:LiF, and LiF:NaF:KF (referred to herein as FLINAK). Most preferably, the melt is composed of FLINAK. In accordance with established methods, the melt should be essentially pure and dry. Impurities can be removed by well-known methods such as pre-electrolysis. To prevent impurities from entering into the system, electrodeposition is carried out in a slow-flowing inert atmosphere typically of argon, in accordance with established methods. Since alkali fluorides generally have high vapor pressures, the use of a vacuum during electrodeposition rather than an inert gas is not recommended.

The preferred sources of carbon are sodium carbonate and potassium carbonate. The most preferred source of carbon is potassium carbonate. Preferably, anywhere from about 0.6 to 6 weight percent carbonate ion, based on the weight of the alkali fluoride melt, can be added to the mixture. The exact amount of carbonate ion used will vary depending on the desired stoichiometry of the coating.

The carbide of any refractory metal should be capable of being electrodeposited according to the process of this invention. Of course, certain routine adjustments to parameters such as the voltage, temperature, percentage of carbon, and percentage of metal-containing compound, may be required. Nevertheless, the required adjustments should be determinable by routine experimentation not involving the use of any inventive faculty. The preferred refractory metals to be used as the anode are tantalum, tungsten, molybdenum, chromium, hafnium, niobium, and titanium. However, attempts at the electrodeposition of chromium carbide at temperatures up to 850° C. failed, and yielded only chromium and carbon. Apparantly, chromium and carbon will not react in the melt at up to 850° C. At temperatures over 850° C., the fluoride melt evaporated. The substitution of a pressurized, inert atmosphere for a flowing, inert atmosphere should allow the achievement of higher melt temperatures and the electrodepositon of chromium carbide.

Preferably, the soluble metal-containing compound is a fluoride salt of the refractory metal. Nevertheless, where tungsten is the refractory metal, the preferred metal containing compound is sodium tungstate. It is believed that in the melt, the sodium tungstate forms a fluoride which forms a stable complex ion. When the refractory metal is tantalum, the preferred metal containing compound is $K_2TaF_7$.

The weight percentage of metal-containing compound is not critical to the successful electrodeposition of the tungsten carbide coating, so long as the amount of compound used is soluble in the melt. Preferably, about 1–10 weight percent of metal-containing compound is added to the melt, based on the weight of the melt. Likewise, the voltage applied is not critical to successful deposition. However, too high of a voltage may cause decomposition of the fluoride melt. Generally, a range of about 0.1 to 2.0 V is sufficient. A range of about 0.1 to 1.5 V is most preferred. Current density merely controls the rate of coating deposition.

One facet of the process of this invention is that the stoichimetric composition of the coating may be controlled by varying the parameters of voltage, weight percent carbonate ion and weight percent metal-containing compound. Surprisingly, temperature had negligible influence. Nevertheless, the temperature must be well above the melting point of the melt and is preferably above about 750° C. Temperatures over about 850° may intefere with deposition by increasing the evaporation rate of various components of the mixture. However, this difficulty may be overcome by the use of a pressurized, inert atmosphere.

Having fully described the invention claimed herein, the following examples are provided to further illustrate the principles of the disclosed invention and are not intended to limit the scope of the invention in any manner.

EXAMPLES 1–14

A FLINAK melt was prepared and placed in a nickel container. $K_2TaF_7$ was vacuum dried and solvent purified by pre-electrolysis between graphite electrodes. Seven weight percent of this purified $K_2TaF_7$, based on the weight of the FLINAK melt, was added to melt. The weight percentages of $K_2CO_3$ shown on table 1, based on the weight of the FLINAK melt, were also added to the melt. A rod of elemental tantalum was placed as the anode, and a strip of elemental nickel was placed as the cathode. Electrochemical reduction was carried out at the voltages shown in table 1 and 20–100 $mA/cm^2$ for about an hour. All of the above operations were carried out in an atmosphere of flowing argon. The results are illustrated in FIG. 1.

TABLE 1

| Example No. | Wt. % $K_2CO_3$ | Volts |
|---|---|---|
| 1 | 1 | 0.6 |
| 2 | 1 | 0.4 |
| 3 | 1 | 0.3 |
| 4 | 1 | 0.2 |
| 5 | 1 | 0.1 |
| 6 | 2 | 0.4 |
| 7 | 2 | 0.2 |
| 8 | 2 | 0.1 |

TABLE 1-continued

| Example No. | Wt. % $K_2CO_3$ | Volts |
|---|---|---|
| 9 | 3 | 0.4 |
| 10 | 3 | 0.2 |
| 11 | 3 | 0.1 |
| 12 | 4 | 0.6 |
| 13 | 4 | 0.4 |
| 14 | 4 | 0.2 |

EXAMPLES 15-32

A FLINAK melt was prepared as in examples 1-14, at about 800° C. Weight percentages, based on the weight of the FLINAK melt, of $Na_2WO_4$ and $K_2CO_3$ as shown in table 2, below, were added to the melt. An elemental tungsten anode and an elemental nickel cathode were also placed in the melt. Electrochemical reduction was carried out at 1.5 V and 250 mA/cm$^2$ for about 1 hour. All of the above operations were carried out in an atmosphere of flowing argon. The results are summarized below on table 2.

TABLE 2

| Example No. | Wt. % $Na_2WO_4$ | Wt. % $K_2CO_3$ | Composition | Current Efficiency |
|---|---|---|---|---|
| 15 | 1 | 2 | $W_2C$ | 26 |
| 16 | 2 | 2 | $W_2C$ | 41 |
| 17 | 3 | 2 | $W_2C$ | 51 |
| 18 | 3 | 3 | $W_2C$ | 32 |
| 19 | 4 | 3 | $W_2C$ | 23 |
| 20 | 2 | 1 | $W_2C$ | 42 |
| 21 | 2 | 2 | $W_2C$ | 19 |
| 22 | 2 | 3 | WC | 8 |
| 23 | 3 | 3 | $W_2C$ | 18 |
| 24 | 4 | 3 | $W_2C$ | 27 |
| 25 | 5 | 3 | $W_2C$ | 34 |
| 26 | 6 | 3 | $W_2C$ | 34 |
| 27 | 7 | 3 | $W_2C$ | 30 |
| 28 | 7 | 4 | $W_2C$ | 34 |
| 29 | 7 | 5 | $W_2C$ | 48 |
| 30 | 7 | 7 | WC | 29 |
| 31 | 7 | 8 | WC | 2 |
| 32 | 7 | 9 | WC | 7 |

All coatings made in examples 1-32 were examined by cross-section and found to be dense. Hardness tests gave a Knoop number in the range of about 1000-1500. Standard abrasion tests showed no detectable abrasion. The coatings were stable in air up to 500° C.

As shown in FIG. 1 and tables 1 and 2, coating composition was dependent on the voltage applied, amount of metal-containing compound used, and the amount of carbonate used. In FIG. 1, where two compositions are shown for the same starting condition, then either a combination of stoichiometries appeared under those conditions or, under nominally the same starting conditions, different trials resulted in different coating compositions. Presumably, higher starting ingredient purities should yield more consistent results. With tungsten carbide, consistent results were obtained.

EXAMPLE 33

A FLINAK melt is prepared as in examples 1-14 at 850° C. Five weight percent $K_2CO_3$ and seven weight percent $MoF_6$ are added to the FLINAK melt, based on the weight of the melt. An anode of elemental molybdenum and a cathode of elemental nickel are also placed in the melt. Electrochemical reduction is carried out at 2.0 V and 250 mA/cm$^2$ for about an hour. All of the above operations are carried out in an inert, flowing atmosphere.

EXAMPLE 34

A FLINAK melt is prepared as in examples 1-14 at 800° C. Five weight percent $K_2CO_3$ and seven weight percent $K_3MoCl_6$ are added to the FLINAK melt, based on the weight of the melt. An anode of elemental molybdenum and a cathode of elemental nickel are also placed in the melt. Electrochemical reduction is carried out at 2.0 V and 250 mA/cm$^2$ for about an hour. All of the above operations are carried out in an inert, flowing atmosphere.

EXAMPLE 35

A FLINAK melt is prepared as in examples 1-14 at 800° C. Five weight percent $K_2CO_3$ and seven weight percent $K_2TiF_6$ are added to the FLINAK melt, based on the weight of the melt. An anode of elemental titanium and a cathode of elemental nickel are also placed in the melt. Electrochemical reduction is carried at 2.0 V and 250 mA/cm$^2$ for about 1 hour. All of the above operations are carried out in an inert, flowing atmosphere.

EXAMPLE 36

A FLINAK melt is prepared as in examples 1-14 at 800° C. Five weight percent $K_2CO_3$ and seven weight percent $K_2CrF_6$ are added to the FLINAK melt, based on the weight of the melt. An anode of elemental zirconium and a cathode of elemental nickel are also placed in the melt. Electrochemical reduction is carried out at 2.0 V and 250 mA/cm$^2$. All of the above operations are carried out in a flowing, inert atmosphere.

EXAMPLE 37

A FLINAK melt is prepared as in examples 1-14 at 800° C. Five weight percent $K_2CO_3$ and seven weight percent $K_2NbF_6$ are added to the FLINAK melt, based on the weight of the melt. An anode of elemental niobium and a cathode of elemental nickel are also placed in the melt. Electrochemical reduction is carried at 1.5 V and 250 mA/cm$^2$. All of the above operations are carried out in a flowing, inert atmosphere.

EXAMPLE 38

A FLINAK melt is prepared as in examples 1-14 at 800° C. Five weight percent $K_2CO_3$ and seven weight percent $K_2HfF_6$ are added to the FLINAK melt based on the weight of the melt. An anode of elemental hafnium and a cathode of elemental nickel are also placed in the melt. Electrochemical reduction is carried out of 2.0 V and 250 mA/cm$^2$ for about 1 hour. All of the above operations are carried out in a flowing, inert atmosphere.

Obviously many modifications and variations of the present invention are possible in the light of the above teachings. It is therefore to be understood that, within the scope of the appended claims, the invention may be practiced otherwise than as specifically described.

What is claimed and desired to be secured by Letters Patent of the United States is:

1. A process for the electrodeposition of a refractory metal carbide upon the surface of an object, the steps of which comprise:

preparing an essentially pure alkali fluoride melt in an inert container;

adding carbonate ions to said melt in the form of alkali carbonate:

adding the refractory metal, the carbide of which is desired to be coated upon said object, to said alkali fluoride melt in the form of a soluble, metal-containing compound;

immersing the elemental form of the refractory metal in said melt as an anode electrode;

immersing the object desired to be coated into said melt as a cathode electrode;

applying a voltage across said electrodes until said cathode has the desired thickness of coating of said carbide of said refractory metal upon its surface.

2. The process of claim 1 wherein said alkali fluoride melt consists essentially of a eutectic mixture of alkali fluorides chosen from the group consisting of LiF:KF, NaF:KF, and LiF:NaF:KF.

3. The process of claim 2 wherein the weight percent of carbonate ions added to said melt is about 0.6–6 percent, based on the weight of said melt.

4. The process of claim 3 wherein said alkali fluoride melt is the eutectic mixture, LiF:NaF:KF.

5. The process of claim 4 wherein said alkali carbonate is selected from the group consisting of $Na_2CO_3$ and $K_2CO_3$.

6. The process of claim 5 wherein said alkali carbonate in $K_2CO_3$.

7. The process of claim 6 wherein the voltage applied across said electrodes is about 0.1–2.0 V.

8. The process of claim 7 wherein said refractory metal is selected from the group consisting of tantalum, molybdenum, titanium, hafnium, chromium, niobium and tungsten.

9. The process of claim 8 wherein said metal is selected from the group consisting of tantalum and tungsten.

10. The process of claim 9 wherein said metal is tantalum and said metal containing compound is $Na_2TaF_7$.

11. The process of claim 9 wherein said metal is tungsten and said metal-containing compound is sodium tungstate.

12. The process of claim 8 wherein said refractory metal is chromium.

13. The process of claim 8 wherein said refractory metal is molybdenum.

14. The process of claim 8 wherein said refractory metal is titanium.

15. The process of claim 14 wherein said metal-containing compound is $K_2TiF_6$.

16. The process of claim 8 wherein said refractory metal is zirconium.

17. The process of claim 8 wherein said refractory metal is niobium.

18. The process of claim 8 wherein said refractory metal is hafnium.

19. A process for the electrodeposition of tantalum carbide upon the surface of an object, the steps of which comprise:

preparing an essentially pure melt of the eutectic mixture, LiF:NaF:KF, at about 750°–850° C.;

adding 0.6 to 6 weight percent carbonate ions to said melt, based upon the weight of said melt, in the form of $K_2CO_3$;

adding tantalum to said melt in the form of $Na_2TaF_7$;

immersing elemental tantalum into said melt as an anode;

immersing the object desired to be coated into said melt as a cathode; and applying about 0.1–2.0 V across said electrodes until said cathode has the desired thickness of coating of tantalum carbide metal upon its surface.

20. A process for the electrodeposition of a tungsten carbide upon the surface of an object, the steps of which comprise:

preparing an essentially pure melt of the eutectic mixture, LiF:NaF:KF, at about 750°–850° C.;

adding 0.6 to 6 weight percent carbonate ions to said melt, based upon the weight of said melt in the form of $K_2CO_3$;

adding tungsten to said melt in the form of sodium tungstate;

immersing elemental tungsten in said melt as an anode;

immersing the object desired to be coated into said melt as a cathode; and applying about 0.1–1.5 V across said electrodes until said cathode has the desired thickness of coating of tungsten carbide upon its surface.

* * * * *